US007104203B2

(12) United States Patent
Lo

(10) Patent No.: US 7,104,203 B2
(45) Date of Patent: Sep. 12, 2006

(54) HEIGHT ADJUSTABLE DEVICE FOR A RETRACTABLE TUBE ASSEMBLY

(76) Inventor: Chiu-Hsiang Lo, No. 20, Lane305, Sec. 3, Chung-Sun Rd., Tan-Tz Shiang, Taichung Hsien (TW)

( * ) Notice: Subject to any disclaimer, the term of this patent is extended or adjusted under 35 U.S.C. 154(b) by 268 days.

(21) Appl. No.: 10/868,067

(22) Filed: Jun. 16, 2004

(65) Prior Publication Data

US 2005/0279261 A1 Dec. 22, 2005

(51) Int. Cl.
*A47B 9/00* (2006.01)

(52) U.S. Cl. ..... 108/147; 248/407; 248/408

(58) Field of Classification Search ..... 108/147, 108/146, 147.19; 248/412, 157, 411, 407, 248/408, 409, 188.5, 188.2
See application file for complete search history.

(56) References Cited

U.S. PATENT DOCUMENTS

| | | | | | |
|---|---|---|---|---|---|
| 176,133 | A | * | 4/1876 | Haworth | 108/4 |
| 390,381 | A | * | 10/1888 | Luetke | 248/411 |
| 390,406 | A | * | 10/1888 | Sittig | 108/146 |
| 398,408 | A | * | 2/1889 | Koehn | 248/411 |
| 2,171,653 | A | * | 9/1939 | Heitmann | 248/409 |
| 2,684,129 | A | * | 7/1954 | Jaseph | 187/206 |
| 3,113,793 | A | * | 12/1963 | Harwood | 403/112 |
| 3,217,672 | A | * | 11/1965 | Haughey | 108/146 |
| 3,999,492 | A | * | 12/1976 | Emrick | 108/146 |
| 4,360,180 | A | * | 11/1982 | Bruneau | 248/162.1 |
| 4,601,246 | A | * | 7/1986 | Damico | 108/146 |
| 4,607,577 | A | * | 8/1986 | Leonardo | 108/146 |
| 4,627,591 | A | * | 12/1986 | Heckmann | 248/411 |
| 5,016,846 | A | * | 5/1991 | Solomon | 248/161 |
| 5,586,830 | A | * | 12/1996 | Wanek et al. | 403/59 |
| 5,894,805 | A | * | 4/1999 | Raasch et al. | 108/146 |
| 5,971,341 | A | * | 10/1999 | Pfister | 248/411 |

* cited by examiner

*Primary Examiner*—Janet M. Wilkens
(74) *Attorney, Agent, or Firm*—Rosenberg, Klein & Lee

(57) ABSTRACT

A height adjustable device is received in the inner tube which is retractably inserted in an outer tube, and includes a base which is fixed in the inner tube and two stop plates are pivotably connected of the base. Two respective first ends of the two stop plates extend through apertures defined through the inner tube and are in contact with two respective insides of the outer tube so as to position the inner tube. A member is movably connected to the base and includes a driving portion for pivoting two respective second ends of the two stop plates. A cable is connected between the movable member and a pivotable member fixed to the inner tube. The pivotable member is pivoted to pull the cable and the two stop plates are pivoted inward so that the inner tube can be freely moved in the outer tube.

8 Claims, 6 Drawing Sheets

HEIGHT ADJUSTABLE DEVICE FOR A RETRACTABLE TUBE ASSEMBLY

FIELD OF THE INVENTION

The present invention relates to a height adjustable device having an outer tube and an inner tube which is retractably inserted in the outer tube and an adjustable device received in the inner tube for positioning the inner tube relative to the outer tube.

BACKGROUND OF THE INVENTION

A conventional height adjustable device for overbed table is disclosed in U.S. Pat. No. 5,775,234 and 4,715,295, and generally includes a hydraulic cylinder received in the retractable tube assembly so as to adjust the height of the inner tube relative to the outer tube. Nevertheless, when adjusting the table by using the hydraulic cylinder, the user has to unlock the cylinder by one hand and press the table by the other hand. This is difficult for a shorter user who needs to stand up at toes and to try to bend his or her arm to press the table downward. Besides, the hydraulic cylinder potentially has a problem of leakage and the maintenance cost is high for an overbed table.

The present invention intends to provide a height adjustable device that is easily to be operated by operating a lever which drives a cable to pull the device in the inner tube so as to unlock the device and the inner tube can be freely moved in the outer tube.

SUMMARY OF THE INVENTION

The present invention relates to a height adjustable tube assembly which comprises an inner tube retractably inserted in an outer tube. A height adjustable device is received in the inner tube and includes a base which is fixed in the inner tube and has two grooves in which two stop plates respectively received. Two respective first ends of the two stop plates extend through apertures defined through the inner tube and are in contact with two respective insides of the outer tube. A movable member is movably connected to the base and includes a driving portion so as to pivot two respective second ends of the two stop plates. A cable is connected between a first end of the movable member and a pivotable member fixed in the inner tube. A resilient member is connected between a second end of the movable member and the base so as to pull the movable member toward in a direction toward the outer tube. The two stop plates are pivoted inward by pivoting the pivotable member so that the inner tube can be freely moved in the outer tube.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
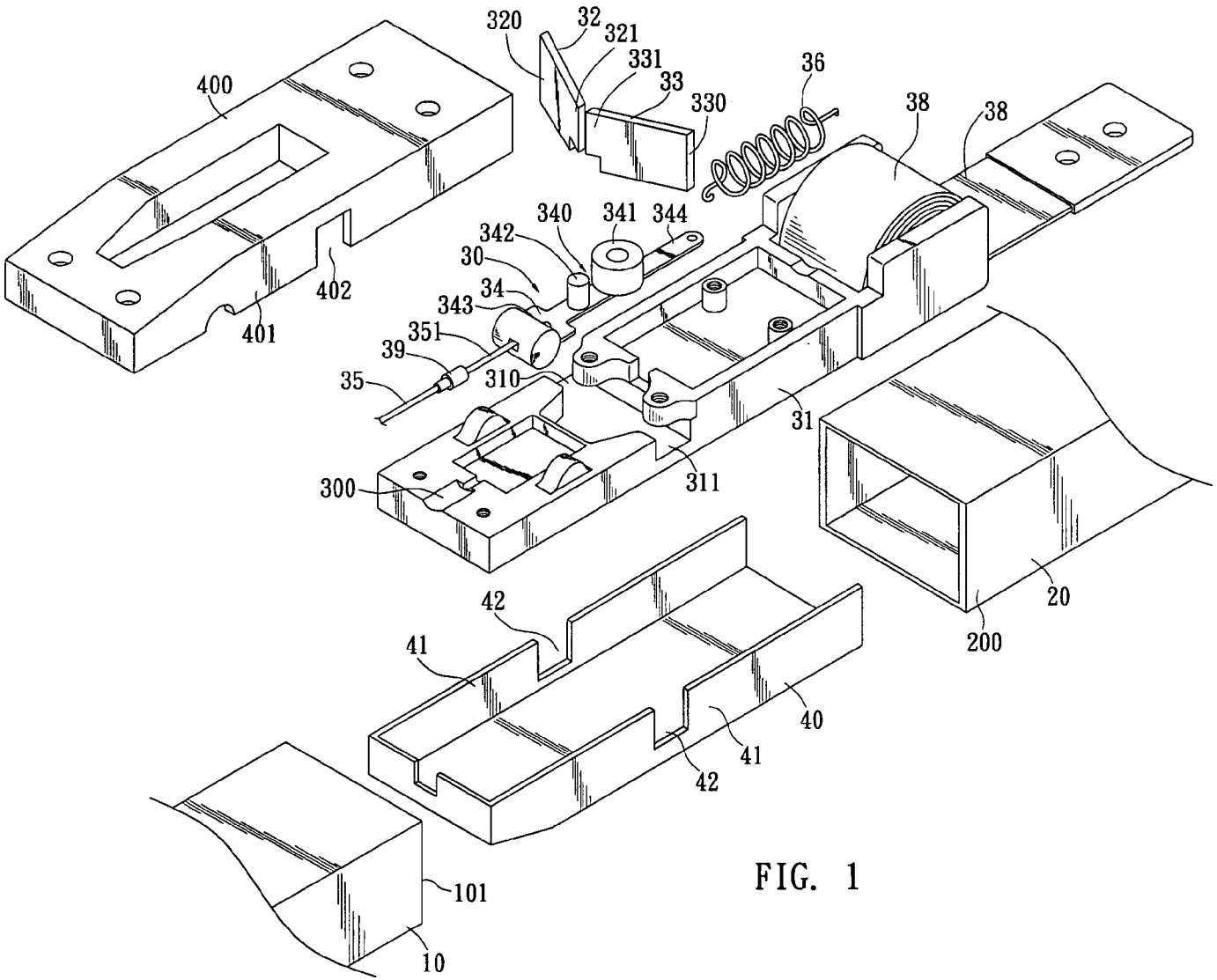
FIG. 1 is an exploded view to show the retractable tube assembly of the present invention.

Referring to FIGS. 1, 3, 4 and 5, the retractable tube assembly of the present invention comprises an inner tube 10 which has a first end 101 thereof retractably inserted in a first end 200 of an outer tube 20. A second end of the inner tube 10 is connected to a first object 50 and a second end of the outer tube 20 is connected to a second object 51. The first object 50 can be a horizontal upper panel, and the second object 51 can be a base for resting on a floor.

A height adjustable device 30 is received in the inner tube 10 and includes a base 31 which is fixed in the inner tube 10 and two grooves 310, 311 are defined in the base 31. The base 31 is sandwiched between a carrying member 40 and a cover 400. Each of the carrying member 40 and the cover 400 has sidewalls 41, 401 and each sidewall 41, 401 includes a notch 42, 402. Two stop plates 32, 33 are respectively received in the two grooves 310, 311 and two respective first ends 320, 330 of the two stop plates 32, 33 extend through the notches 41, 401 of the carrying member 40 and the cover 400, and apertures 11 defined through the inner tube 10, and are in contact with two respective insides of the outer tube 20. A movable member 34 is movably connected to the base 31 and includes a driving portion 340 which is composed of a first rod 341 and a second rod 342, the two respective second ends 321, 331 of the two stop plates 32, 33 are located between the first and second rods 341, 342. The two stop plates 32, 33 are oriented an angle relative to a longitudinal axis of the base 30.

A cable 35 has a first end 351 thereof fixed to a first end 343 of the movable member 34 and a cone-shaped member 39 is connected to the cable 35 so as to be securely engaged with a recess 300 defined in the first end of the base 31. A second end 344 of the movable member 34 is connected to an end of a resilient member 36 and the other end of the resilient member 36 is connected to a second end of the base 31. The resilient member 36 is a spring in this embodiment. A coil board 38 has a first end 380 thereof fixed to the second end of the base 31 in the inner tube 10 and a second end 381 of the coil board 38 is fixed to the outer tube 20.

A second end 350 of the cable 35 is connected to a center of a pivotable member 37. A first end 370 of the pivotable member 37 is pivotably connected to the inner tube 10 and a lever 371 extends form a second end of the pivotable member 37.

Figure 6:
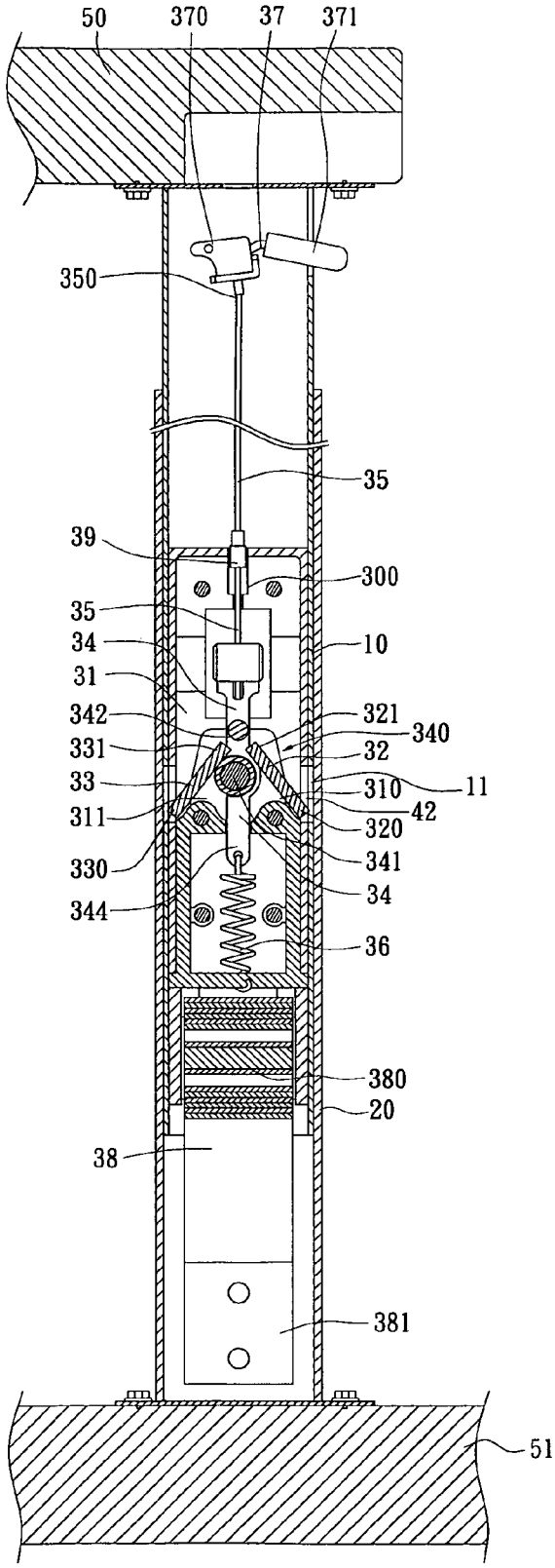
FIG. 6 shows the lever is operated to pull the movable member and the two stop plates are pivoted inward.

Further referring to FIG. 6, when pivoting the lever 371 as shown, the cable 35 pulls the movable member 34 in a direction away from the outer tube 20 and the movement of the movable member 34 pivots the two respective second ends 321, 331 of the two stop plates 32, 33. The two respective first ends 320, 330 are then pivoted inward and separated from the inside of the outer tube 20 so that the inner tube 10 can be freely moved in the outer tube 20. When the inner tube 10 is moved to a desired position, the lever 371 is released and the movable member 34 is pulled back by the coil board 38, and the two stop plates 32, 33 are expanded to contact the inside of the outer tube 20 again to position the inner tube 10.

Figure 2:
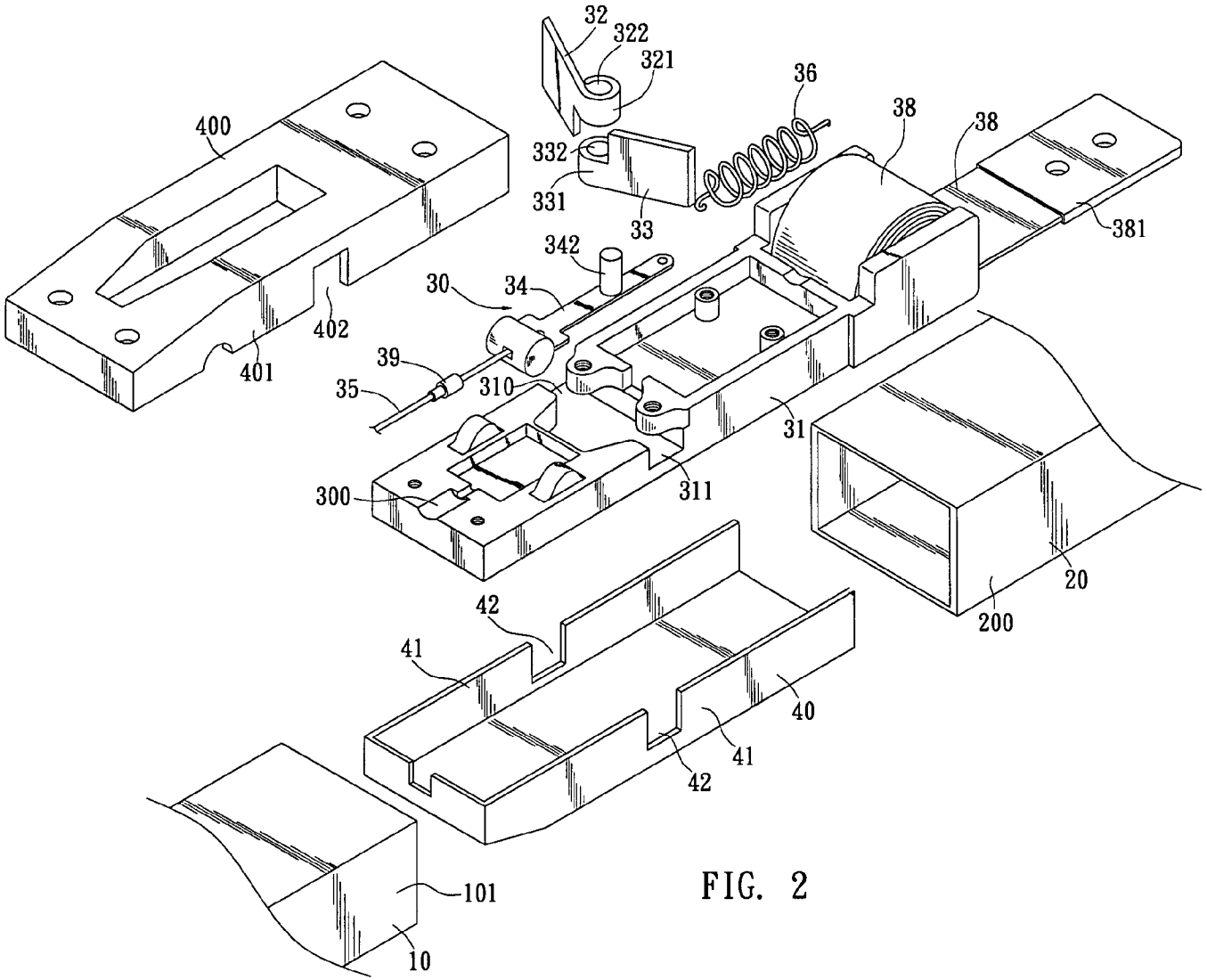
FIG. 2 shows another embodiment of the stop plates and the movable member of the height adjustable device of the retractable tube assembly of the present invention.
Figure 3:
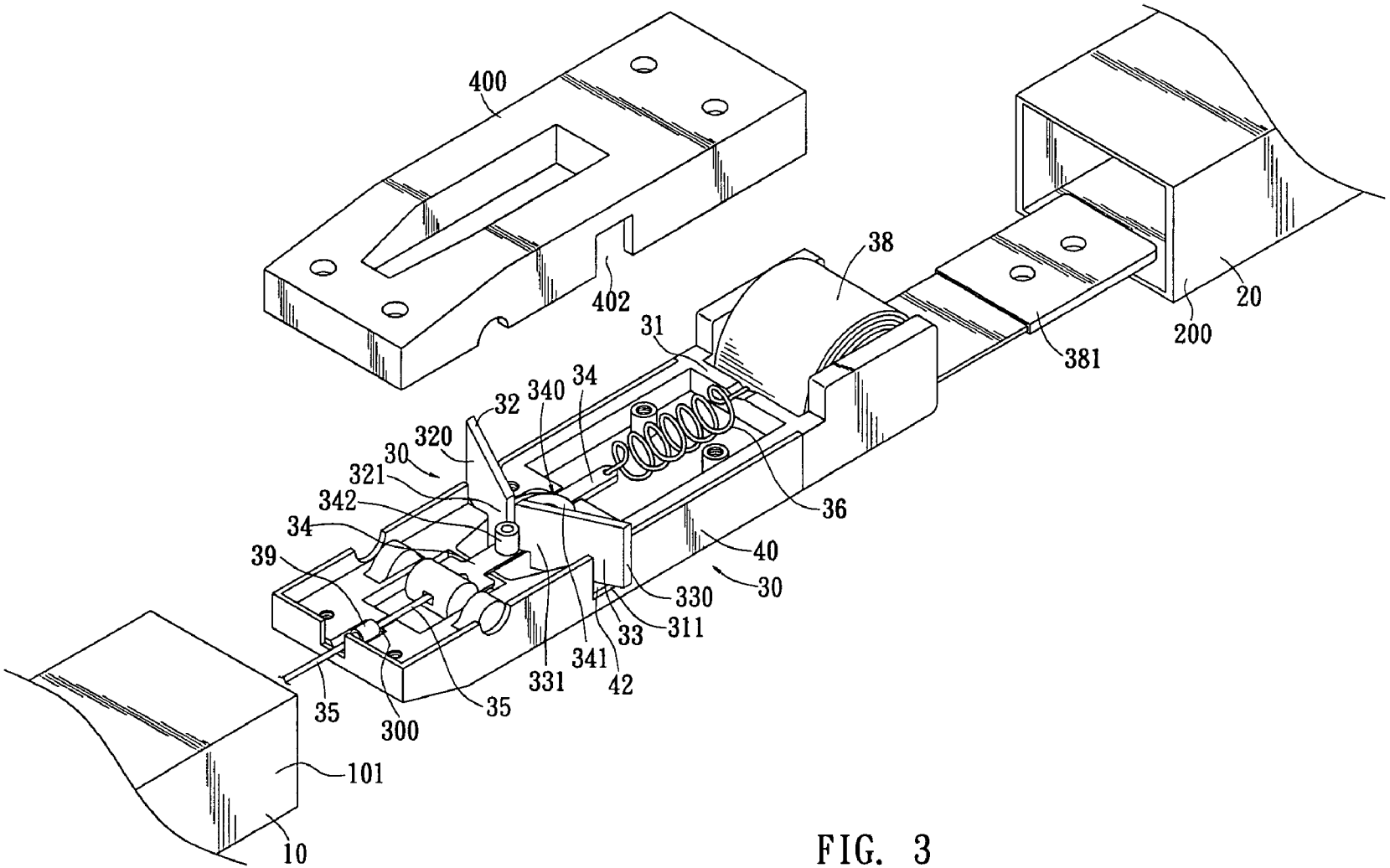
FIG. 3 shows a cover is to be mounted to the height adjustable device in the retractable tube assembly of the present invention.
Figure 4:
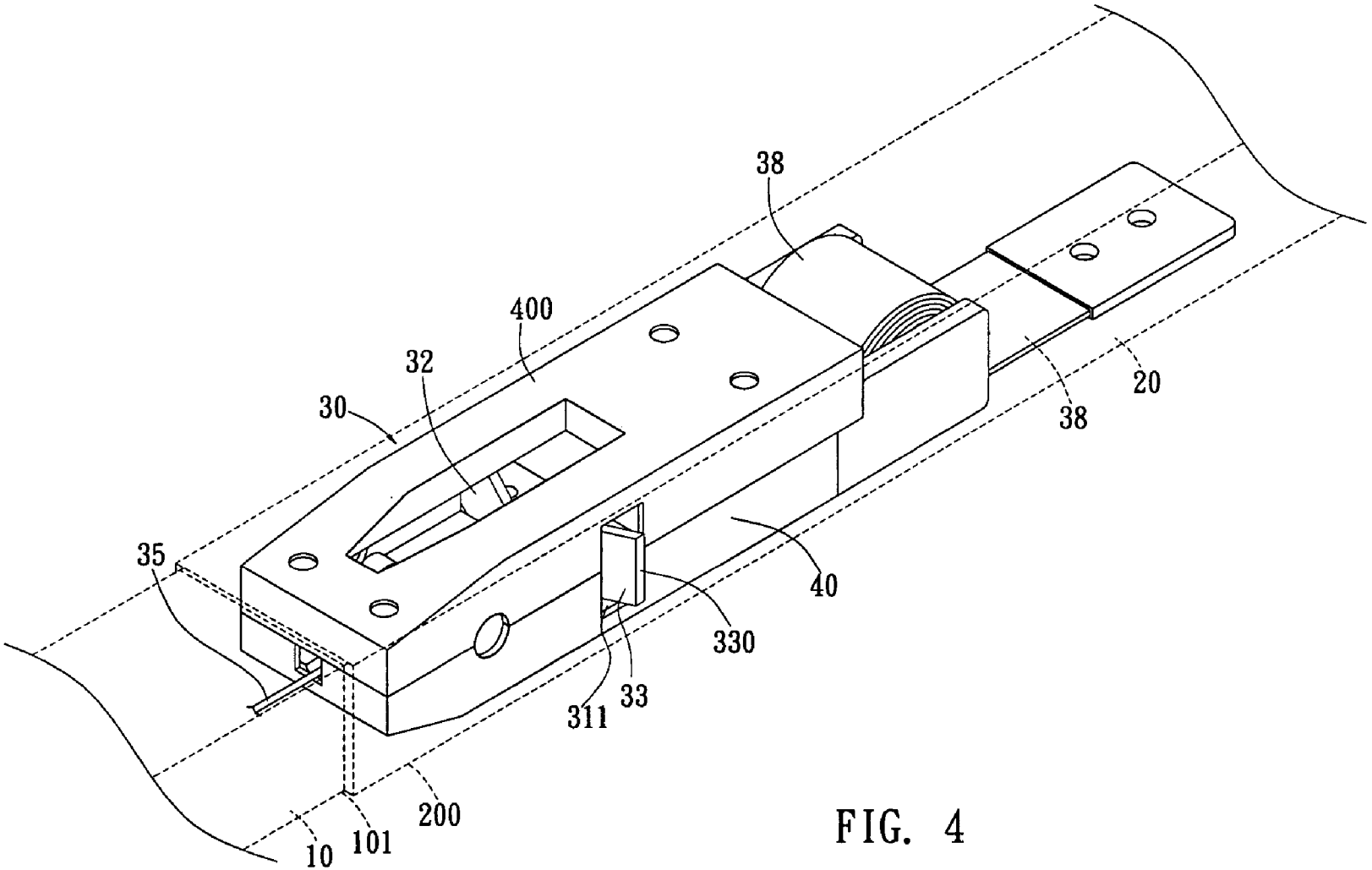
FIG. 4 is a perspective view of the height adjustable device in the retractable tube assembly of the present invention.
Figure 5:
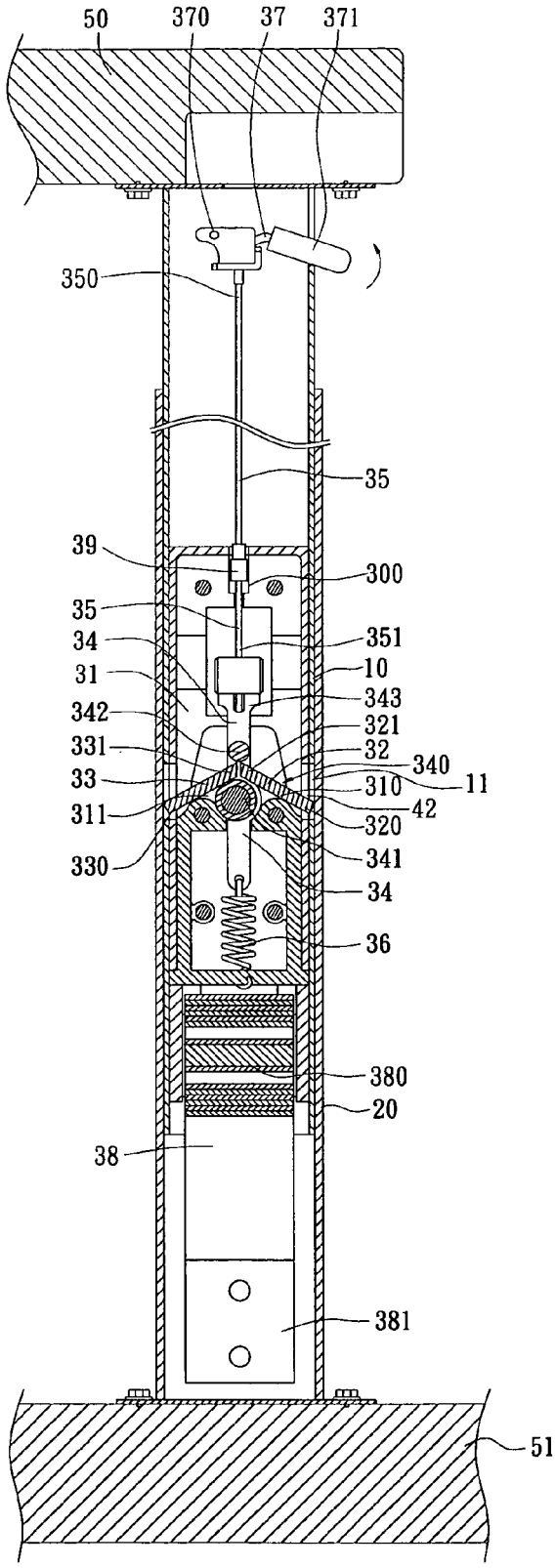
FIG. 5 is a cross sectional view to show the height adjustable device in the retractable tube assembly of the present invention.

As shown in FIG. 2, the driving portion 340 can be a shaft 342 and each of the two respective second ends 321, 331 of the two stop plates 32, 33 has a passage 322/332 through which the shaft 342 extends. This embodiment ensures that the two stop plates 32, 33 are pivoted when the movable member 34 is moved.

While we have shown and described the embodiment in accordance with the present invention, it should be clear to those skilled in the art that further embodiments may be made without departing from the scope of the present invention.

What is claimed is:

1. A height adjustable tube assembly comprising:

an inner tube (10);

an outer tube (20) in which the inner tube (10) is retractably inserted;

a height adjustable device (30) received in the inner tube (10) and including a base (31) which is fixed in the inner tube (10) and two grooves (310, 311) defined in the base (31), two stop plates (32, 33) respectively received in the two grooves (310, 311) and two respective first ends (320, 330) of the two stop plates (32, 33) extending through apertures (11) defined through the inner tube (10) and being in contact with two respective insides of the outer tube (20), a movable member (34) movably connected to the base (31) and including a driving portion (340) which pivots two respective second ends (321, 331) of the two stop plates (32, 33), a cable (35) having a first end (351) thereof fixed to a first end (343) of the movable member (34) so as to pull the movable member (34) in a direction away from the outer tube (20), a resilient member (36) connected between a second end (344) of the movable member (34) and the base (31) so as to pull the movable member (34) in a direction toward the outer tube (20).

2. The assembly as claimed in claim 1, wherein the driving portion (340) is a shaft (342) and each of the two respective second ends (321, 331) of the two stop plates (32, 33) has a passage (322/332) through which the shaft (342) extends.

3. The assembly as claimed in claim 1, wherein the driving portion (340) includes a first rod (341) and a second rod (342), the two respective second ends (321, 331) of the two stop plates (32, 33) are located between the first and second rods (341, 342).

4. The assembly as claimed in claim 1, wherein the resilient member (36) is a spring.

5. The assembly as claimed in claim 1, wherein a second end of the cable (35) is connected to a center of a pivotable member (37), a first end (370) of the pivotable member (37) pivotably connected to the inner tube (10) and a lever (371) extending from a second end of the pivotable member (37).

6. The assembly as claimed in claim 1 further comprising a coil board (38) which has a first end thereof fixed to the inner tube (10) and a second end of the coil board (38) fixed to the outer tube (20).

7. The assembly as claimed in claim 1 wherein, the second end of the inner tube (10) is connected to a first object (50) and the second end of the outer tube (20) is connected to a second object (51).

8. The assembly as claimed in claim 7 wherein, the first object (50) is a horizontal upper panel, and the second object (51) is a base for resting on a floor.

* * * * *